US005742050A

United States Patent [19]

Amirav et al.

[11] Patent Number: 5,742,050

[45] Date of Patent: Apr. 21, 1998

[54] METHOD AND APPARATUS FOR SAMPLE INTRODUCTION INTO A MASS SPECTROMETER FOR IMPROVING A SAMPLE ANALYSIS

[75] Inventors: Aviv Amirav, Ramat Hasharon; Tzvi Shahar, Petach-Tiqwa; Shai Dagan, Ramat Gan, all of Israel

[73] Assignee: Aviv Amirav, Ramat Hasaroh, Israel

[21] Appl. No.: 723,095

[22] Filed: Sep. 30, 1996

[51] Int. Cl.[6] ..... H01J 49/04

[52] U.S. Cl. ..... 250/288; 250/287

[58] Field of Search ..... 250/288, 288 A, 250/287; 73/864.81

[56] References Cited

U.S. PATENT DOCUMENTS

| | | | |
|---|---|---|---|
| 2,991,158 | 7/1961 | Harley et al. | 23/254 |
| 4,201,550 | 5/1980 | Noszticzius et al. | 23/232 E |
| 4,271,022 | 6/1981 | Dixon et al. | 210/198.2 |
| 5,037,518 | 8/1991 | Young et al. | 204/230 |
| 5,153,673 | 10/1992 | Amirav | 356/315 |
| 5,294,797 | 3/1994 | Frey et al. | 250/288 |
| 5,317,932 | 6/1994 | Westlake, III et al. | 73/864.73 |
| 5,342,494 | 8/1994 | Shane et al. | 204/252 |
| 5,373,156 | 12/1994 | Franzen | 250/288 |
| 5,398,559 | 3/1995 | Westlake, III et al. | 73/863.81 |
| 5,442,968 | 8/1995 | Westlake, III et al. | 73/863.23 |

FOREIGN PATENT DOCUMENTS

| | | | |
|---|---|---|---|
| 57-13660 | 1/1982 | Japan | 250/288 |
| 1584978 | 2/1981 | United Kingdom . | |

*Primary Examiner*—Jack I. Berman

*Attorney, Agent, or Firm*—McAulay Fisher Nissen Goldberg & Kiel, LLP

[57] ABSTRACT

There is provided a method for sample introduction into a mass spectrometer for performing sample analysis, including desorbing a sample by a laser beam and forming gaseous sample compounds, sweeping desorbed sample compounds with a carrier gas into a transfer line, transferring the sample compounds in the transfer line into a supersonic nozzle, expanding the sample compounds mixed with the carrier gas from the supersonic nozzle to form a supersonic free jet inside a vacuum chamber of a mass spectrometer, and ionizing and mass analyzing the sample compounds for the purpose of identification and/or quantification of the sample. An apparatus for carrying out the method is also provided.

33 Claims, 6 Drawing Sheets

METHOD AND APPARATUS FOR SAMPLE INTRODUCTION INTO A MASS SPECTROMETER FOR IMPROVING A SAMPLE ANALYSIS

BACKGROUND OF THE INVENTION

The present invention relates to a method and apparatus for sample introduction into a mass spectrometer for performing sample analysis.

DESCRIPTION OF THE PRIOR ART

Mass spectrometry (MS) is a powerful tool for chemical analysis, combining excellent sensitivity and high level of molecular identification capability that in many cases enables sample identification. For the analysis of samples in complex matrices, a gas chromatograph (GC) is coupled to the MS to form a GC-MS that combines the capability of GC sample separation in time with the detection and identification capabilities of MS. Thus, GC-MS is considered to be the main analytical tool for chemical analysis. It is widely recognized that sample preparation constitutes the bottleneck in the whole analysis and often requires several hours of expensive sample clean-up, extraction and concentration procedures in order to make it amenable for GC-MS analysis. A standard estimate for pesticide analysis in fruit and vegetables, or drug analysis in urine is about 2 hours for the preparation of a sample and about 30 minutes of the GC-MS analysis. The requirement for wet chemical or other sample preparation methods also eliminates spatial sample information in cases where the sample is unhomogenously deposited on a given surface or in the bulk.

Laser desorption methods are of growing importance in combination with mass spectrometry, and in-vacuum laser desorption mass spectrometry methods are commercially available. Laser desorption of a sample placed in vacuum is known to be especially effective for the analysis of large bio-molecules. In some applications, the "in-vacuum" desorbed molecules are further swept and entrained in an expanding supersonic free jet where the supersonic nozzle source is close to the laser desorption focal point on the sample that is inside the vacuum chamber.

When a given sample is placed inside a vacuum chamber, however, all the information concerning volatile organic matter is lost and the information on semi-volatile compounds is biased. In addition, the ability to use a GC is precluded. The use of focused or slightly defocused laser light for sample desorption and volatilization, seems to be the ideal tool to eliminate sample preparation and to retain the spatial sample position information. Moreover, the laser can also drill inside the bulk of a material and provide three-dimensional chemical information. Laser desorption in the open air or at a slightly higher inert atmosphere, is, however, confronted with problems of ineffective sample transfer to the mass spectrometer. In standard MS and GC-MS instruments, the column flow rate is limited to 1–2 ml/min due to limited pumping capacity of the MS pumps. Since the laser desorbed sample may expand into one milliliter volume or more, depending on the laser pulse energy, the sample transfer to the column may last more than one minute and volatile compounds can be poorly separated by the GC. In addition, the slow (typically 30 minutes) GC precludes the possibility of effective surface chemical mapping that could be realised only if a much faster GC-MS analysis could be achieved.

A broad object of this invention is to provide a method and apparatus for enabling a much faster and more informative Laser Desorption (LD)-MS chemical analysis that will not be confronted with the limitations outlined above. One of the major aspects and advantages of the use of the LD-MS is its capability of sample injection at its natural condition, without sample preparation. This can be achieved by the combination of ambient or higher pressure laser desorption sampling with sample interface into the mass spectrometer through a supersonic expansion. This method can be further improved if the sample compound ionization is performed in the resulting supersonic molecular beam (SMB). Supersonic expansion occurs when a gas expands through a pinhole, typically 80–150 μm diameter, into vacuum. The supersonic expansion is performed in a differentially pumped additional vacuum chamber and the relative concentration of the sample is highly enriched in the central line of the expansion. Thus, if this central portion of the expansion is skimmed and transferred to the mass spectrometer vacuum chamber, sample enrichment occurs and while most of the heavy sample compounds enter the MS chamber, the majority of the light carrier gas, such as hydrogen or helium, is differentially pumped. This known "jet separation", when coupled with laser desorption, provides two very important advantageous features:

1. High carrier gas flow rate is permitted for superior transfer of laser desorbed sample into the transfer line or GC column, and
2. The high carrier gas flow rate in the transfer line or GC column, enables very fast analysis either with, or without, GC separation.

The supersonic expansion is also characterized by the supercooling of the intramolecular degrees of freedom and by the possible acceleration of the sample compounds that acquire hyperthermal kinetic energy (1–30 eV). These two additional features are very important for achieving a fast and informative LD-MS. The molecular hyperthermal kinetic energy enables vacuum background elimination based on differences in the ion energy of background ions and ions of molecules ionized in the supersonic molecular beam. Consequently, background ion filtration is achieved with simple electrostatic retarding or deflecting fields. Background ion filtration facilitates ultra fast ion source response time, since any molecule that scatters from a given wall would lose its directional kinetic energy and be filtered if ionized as thermal background. This feature also enables tail-free high temperature GC-MS to be achieved without ion source related limitations. It also exposes the genuine electron impact mass spectrum of the vibrationally cold sample compounds. These unique electron impact mass spectra are characterized by enhanced molecular ion peaks, by the total control of the degree of molecular ion dissociation through the reduction of the ionizing electron energy, by enhanced and clearer isomer mass spectral effects and, by additional isotopic and elemental information. In addition, the hyperthermal molecular kinetic energy enables another ionization method to be employed, namely, hyperthermal surface ionization (HSI). HSI is based on the large (orders of magnitude) increase in the surface ionization yield of organic compounds upon their hyperthermal surface scattering from a suitable solid surface in comparison with thermal surface ionization. Thus, HSI was found to be a very efficient ionization method with a tunable degree of ionization selectivity that favors the ionization of compounds with low ionization potential such as aromatic compounds and nitrogen containing drugs over aliphatic compounds.

The combination of the unique features of SMB and its high flow rate capacity enables very fast GC-MS analysis to be achieved ranging from 1 second to a few minutes. The very short residence time in the heated short transfer line or GC column, also largely reduces the thermal dissociation of thermally labile compounds. The ability to analyze fragile organic compounds is a very important additional benefit of the use of high flow rate supersonic expansion. As a result, the coupling of laser desorption injection with mass spectrometry through a supersonic expansion provides a new and very powerful tool for chemical analysis, characterized by the following desirable features:

1. Very fast analysis is achieved;
2. The fast analysis can be combined with fast GC separation;
3. Effective and efficient sweeping of the laser desorbed species is performed followed by their efficient transfer into the MS ion source;
4. Open air ambient laser desorption at a pressure of about 1 atmosphere can be achieved for easy and flexible sample handling;
5. The laser desorption chamber can be held at low temperatures to retain the volatile organic compounds for this measurement;
6. Any column can be used at any length and carrier gas flow rate for tailoring the optimal trade-off between GC resolution, sensitivity and analysis time;
7. Effective flow programming can be employed due to the large flow rate tolerance, for optimal laser desorption injection combined with optimal GC resolution. Flow programming can also serve as an effective way of achieving fast GC of a mixture of compounds having a large boiling point range;
8. Laser desorption microscopy chemical analysis can be achieved due to the fast analysis and the sample surface can be scanned for two dimensional chemical mapping;
9. Very complex samples and matrices can be analyzed due to the enhanced selectivity of mass spectrometry in SMB;
10. Relatively thermally labile compounds can be analyzed by the GC-MS with the supersonic expansion interface;
11. Sample injection by laser desorption eliminates or substantially reduces the need for sample preparation;
12. The open air or purged LD inlet enables LD injection of flowing liquid samples, and
13. High frequency, repetitive fast sampling and analysis can be performed to continuously control process qualities.

SUMMARY OF THE INVENTION

In accordance with the present invention there is therefore provided a method for sample introduction into a mass spectrometer for performing sample analysis, comprising desorbing a sample by means of a laser beam and forming gaseous sample compounds, sweeping desorbed sample compounds with a carrier gas into a transfer line, transferring the sample compounds in said transfer line into a supersonic nozzle, expanding the sample compounds mixed with said carrier gas from the supersonic nozzle to form a supersonic free jet inside a vacuum chamber of a mass spectrometer, and ionizing and mass analyzing the sample compounds for the purpose of identification and/or quantification of said sample.

The invention further provides an apparatus for sample introduction into a mass spectrometer for performing sample analysis, comprising a sample container arranged for positioning a sample to be analyzed therein for subsequent desorption by means of a laser beam directed thereon to form sample compounds, means for introducing a carrier gas in said container for sweeping desorbed sample compounds into a transfer line being in fluid communication at one end thereof, with said container and leading to a supersonic nozzle at the other end thereof, to enable a supersonic free jet of said desorbed sample compounds to be expanded into a vacuum chamber of a mass spectrometer.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DESCRIPTION OF THE PREFERRED EMBODIMENTS

Figure 1:
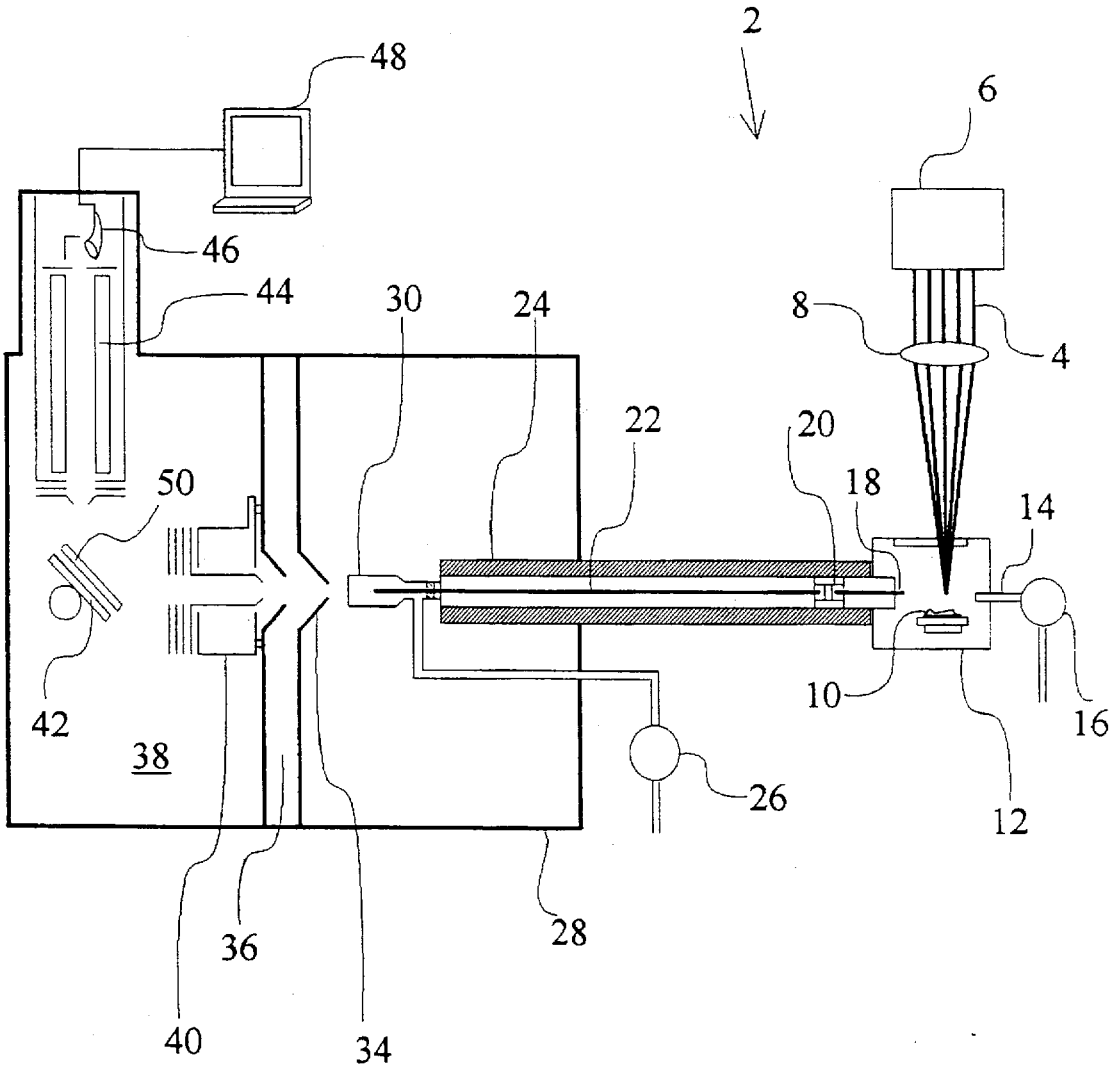
FIG. 1 is a schematic diagram of a laser desorption mass spectrometer apparatus according to the present invention.

In FIG. 1 there is shown a schematic diagram of the laser desorption mass spectrometer apparatus having a sample introduction portion 2. Seen is a laser light beam 4 produced by a laser 6 focused by an optical system 8 on a sample 10 placed in the sample compartment 12. The laser beam desorbs the sample to form sample components which are further vaporized to form sample compounds. The compartment 12 is fitted with a gas inlet 14 for the introduction of a carrier gas, the flow of which is controlled by a valve 16. A short column 18 serves as an outlet from the compartment 12 and advantageously, leads via a filter 20, to a standard GC column transfer line 22. The latter can also serve as a fast GC short column for fast GC separation by means of a temperature controlled oven 24. At the exit of the transfer line 22, the sample compounds and carrier gas are optionally mixed with a make-up gas provided via control valve 26 to be expanded into a vacuum chamber 28 through a supersonic nozzle 30, forming a supersonic free jet. The central portion of the supersonic free jet is then further collimated by a skimmer 34 and transferred in the form of a molecular beam through a differential pumping chamber 36 into the mass spectrometer's main vacuum chamber 38. The supersonic molecular beam is, in turn, ionized by an electron ionization ion source 40 and the ions are deflected by an ion mirror 42, at an angle of substantially 90°, into a mass analyzer 44 constituted by a quadruple mass analyzer, to be detected by an ion detector 46. Advantageously, the ionization of the sample compounds can also be carried out by a laser. The resulting signals are processed and displaced by microcomputer 48. A suitable surface 50 can be provided above the surface of the ion mirror 42 and is positioned in the SMB trajectory for HSI.

Figure 2:
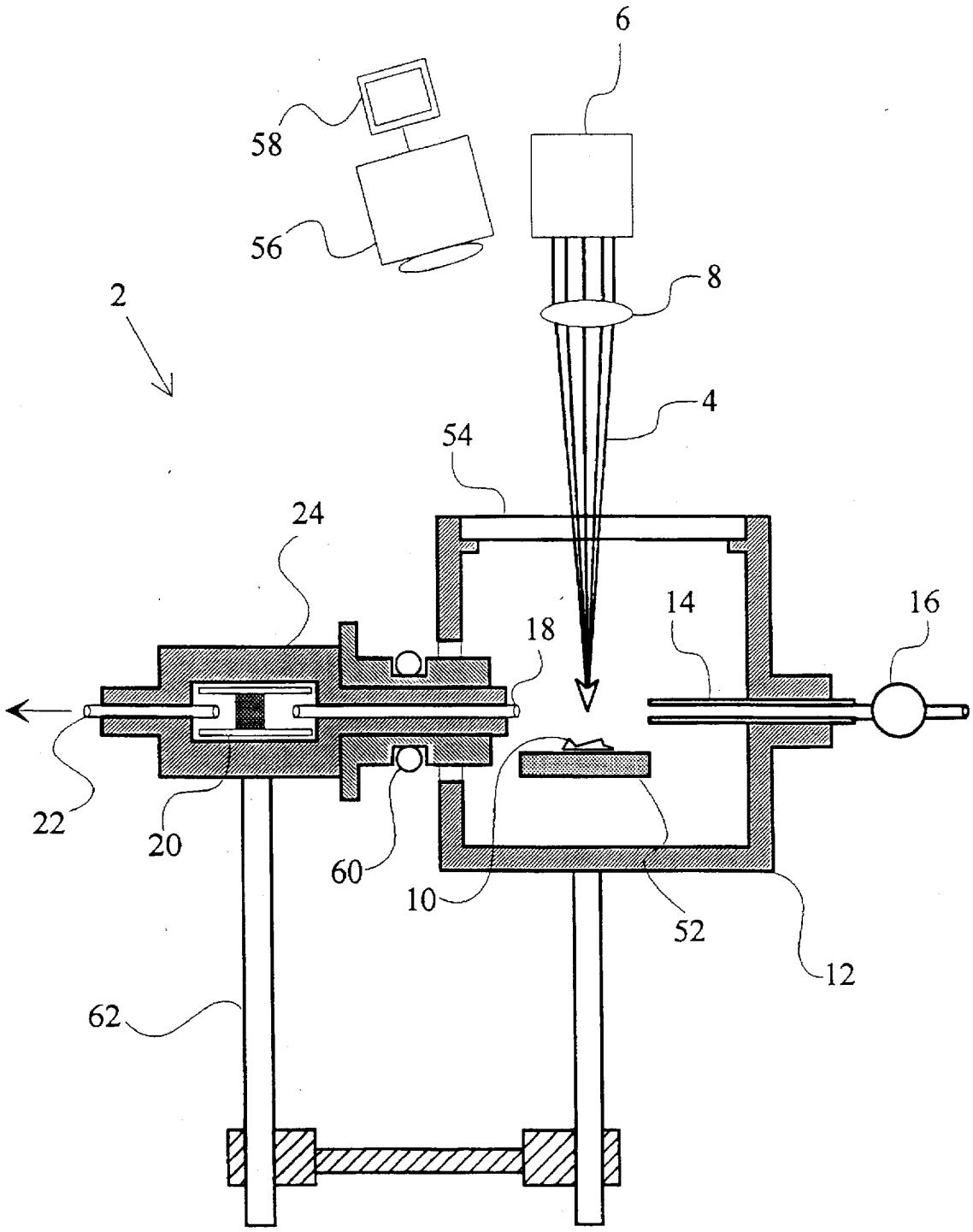
FIG. 2 is a more detailed schematic diagram of a portion of the apparatus of FIG. 1, and FIGS. 3 to 6 are chromatograms of test results carried out on various samples with the apparatus and in accordance with the method of the present invention.

In FIG. 2 there is illustrated a more detailed schematic diagram of the laser desorption inlet portion 2. The sample 10 is introduced on the sample support 52 beneath a window 54 formed in the upper wall of compartment 12. The laser 6 emits a light beam 4 that is focused and guided by the optical system 8 onto the sample 10, which, during operation, can be viewed by a microscope 56, with or without a video monitor 58. The laser 6 may advantageously be a pulsed laser operating in a high frequency periodic fashion. The desorption may also be performed by several laser pulses transmitted at a controlled repetition and time for total desorption. During desorption, adsorbing reagent may optionally be added. The laser desorbed sample compounds are swept by the carrier gas, the flow rate of which is controlled by valve 16, into the introduction short capillary column 18. The sample and carrier gas are transferred through the dust and particle heated filter 20 into the heated GC separation or transfer line 22. The laser desorption compartment 12 and outlet line 18 are thermally insulated from the heated transfer line 22 and the contact area thereinbetween can be sealed by a seal 60. Alternatively, a carrier gas protective purge flow can be provided. The flow rate of the sample compounds and carrier gas from the line 22 can be controlled by a make up gas through the control valve 26 (FIG. 1). The sample introduction portion 2 may advantageously be thermally insulated by a suitable support 62.

While the GC and sample introduction portion 2 described above are "home-made" apparatus, it is understood that a standard commercially available GC can also be coupled to the laser desorption introduction portion 2, following a similar approach.

The sample analysis may be performed in a MS—MS or $MS^n$ system. The laser desorption can be achieved by means of sample vaporization, sample ablation, or by means of sample blasting into small dust particles, techniques. When the last-mentioned technique is used, the dust particles are, in turn, further thermally vaporized inside the heated transfer line or GC.

Figure 3:
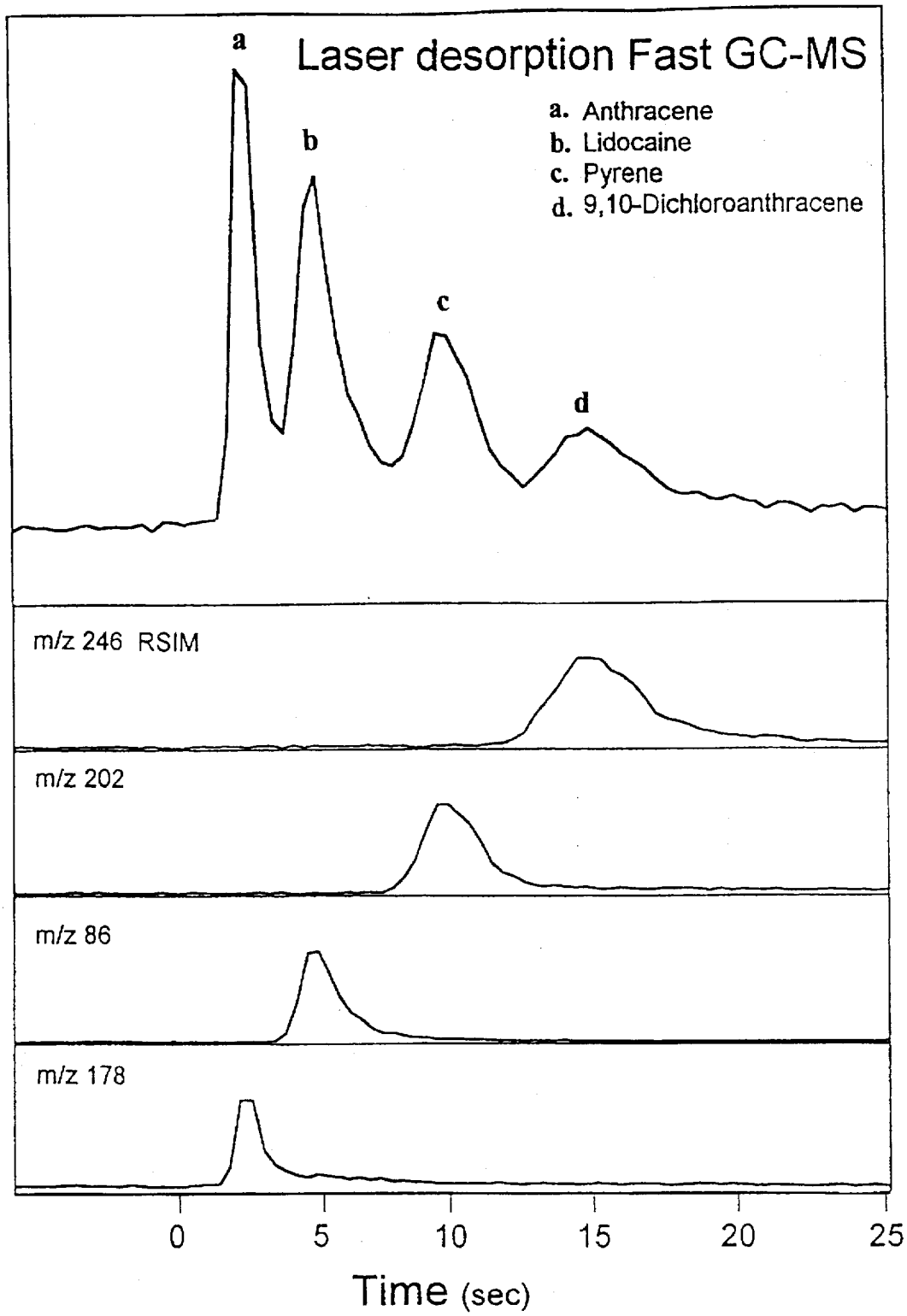

In FIG. 3 there are shown chromatograpms of ultra fast laser desorption GC-MS trace emerging from laser desorption of a synthetic mixture of a) anthracene, b) lidocaine, c) pyrene and d) 9,10-dichloroanthracene placed on a glass surface. A train of 20 pluses of XeCl Excimer laser was used for desorption, with pulse energy of 3 mJ each. It is shown that with half a meter short capillary column (0.53 mm ID), these compounds are vaporized and separated in time and the computer reconstructed chromatograms provide clean and quantitatively time-integrated peaks for each compound. Note should be made of the short GC time of under 20 seconds.

Figure 4:
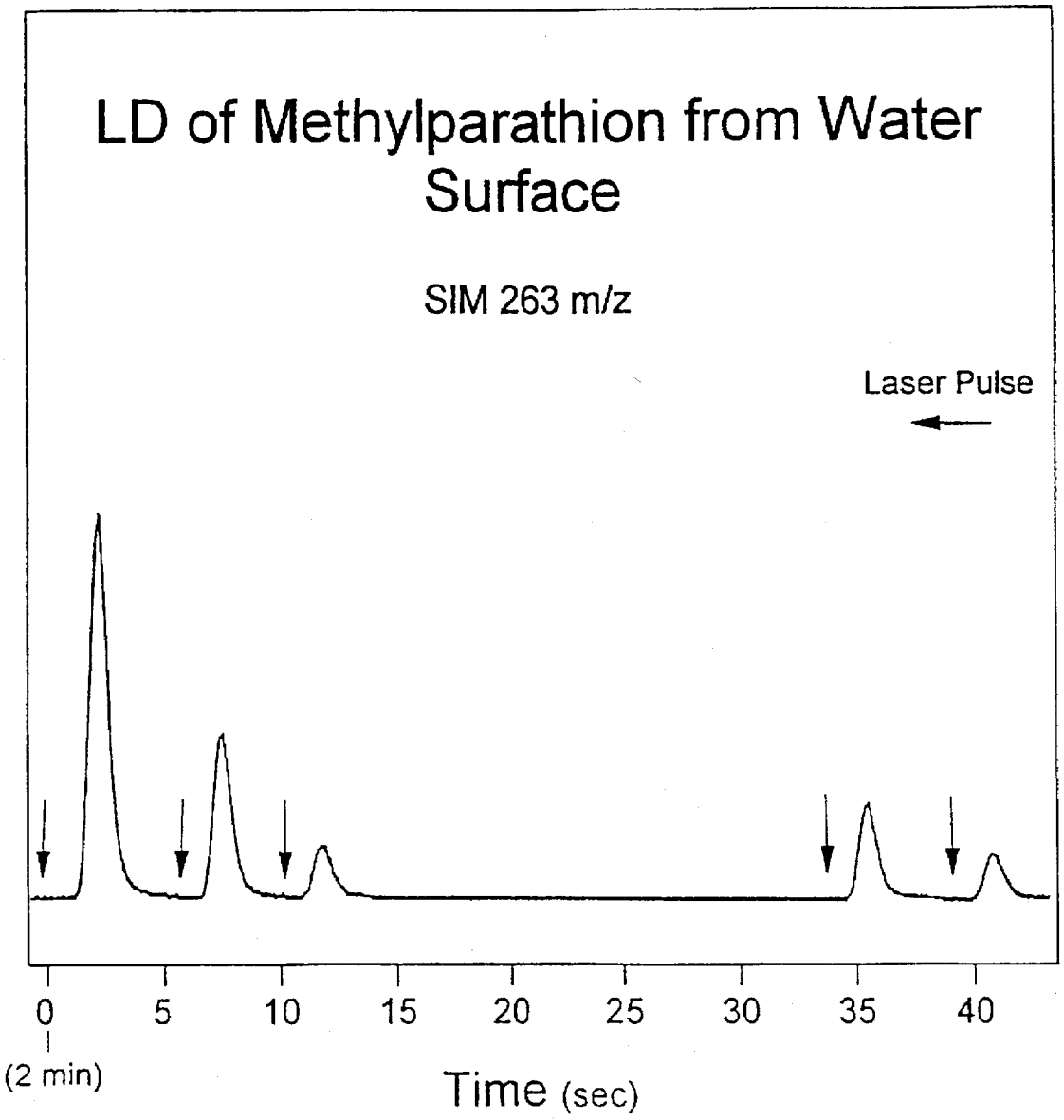

In FIG. 4 there is illustrated the LD-GC-MS of methylparathion desorbed from the surface of liquid water. A large drop of water spiked with the pesticide was placed on the concaved sample holder. Five laser desorption events are shown, where each pesticide peak appears 2.5 seconds after the laser pulse. It is shown that each laser train of pulses depeleted about 50% of the pesticide on the water surface. After a waiting period of 25 seconds, the water surface concentration was partially recovered. The most important aspect shown in FIG. 4 is the demonstrated capability of analyzing an organic compound in a volatile liquid solution. This application cannot be performed by any of the known "in-vacuum" laser desorption methods.

Figure 5:
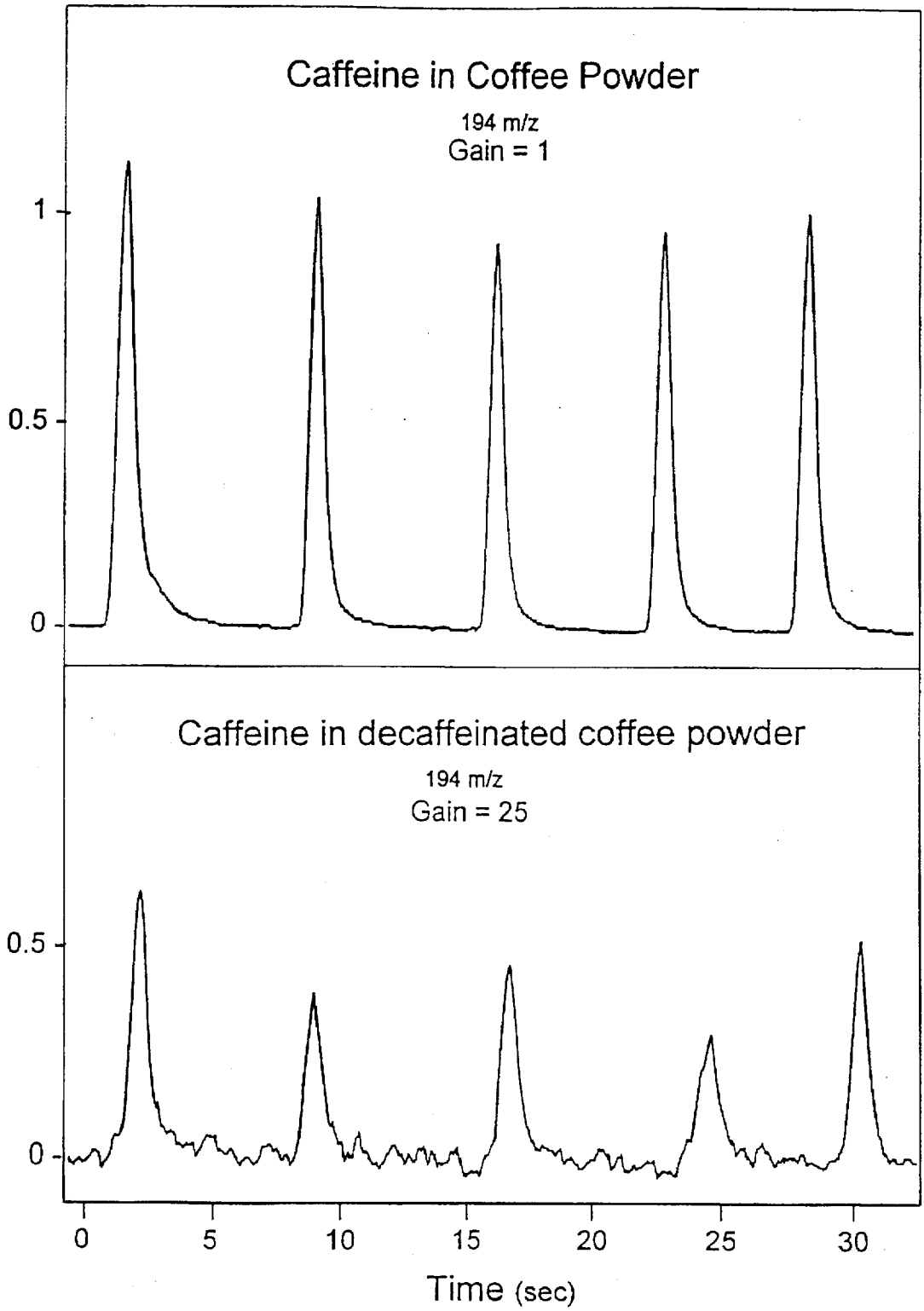

In FIG. 5 the determination of relative caffeine content in decaffeinated coffee is shown. Instant coffee powder was used as is without any sample treatment. A certain brand of coffee powder was studied. For achieving better precision, five consecutive laser desorption pulses were applied, and the five results were averaged. It is shown that considering the gain increase by a factor of 25 with the lower trace, the relative content of caffeine in the decaffeinated coffee is close to 2% of that in the regular coffee, exemplifying the use of LD-GC-MS for the analysis of organic matter in powders.

Figure 6:
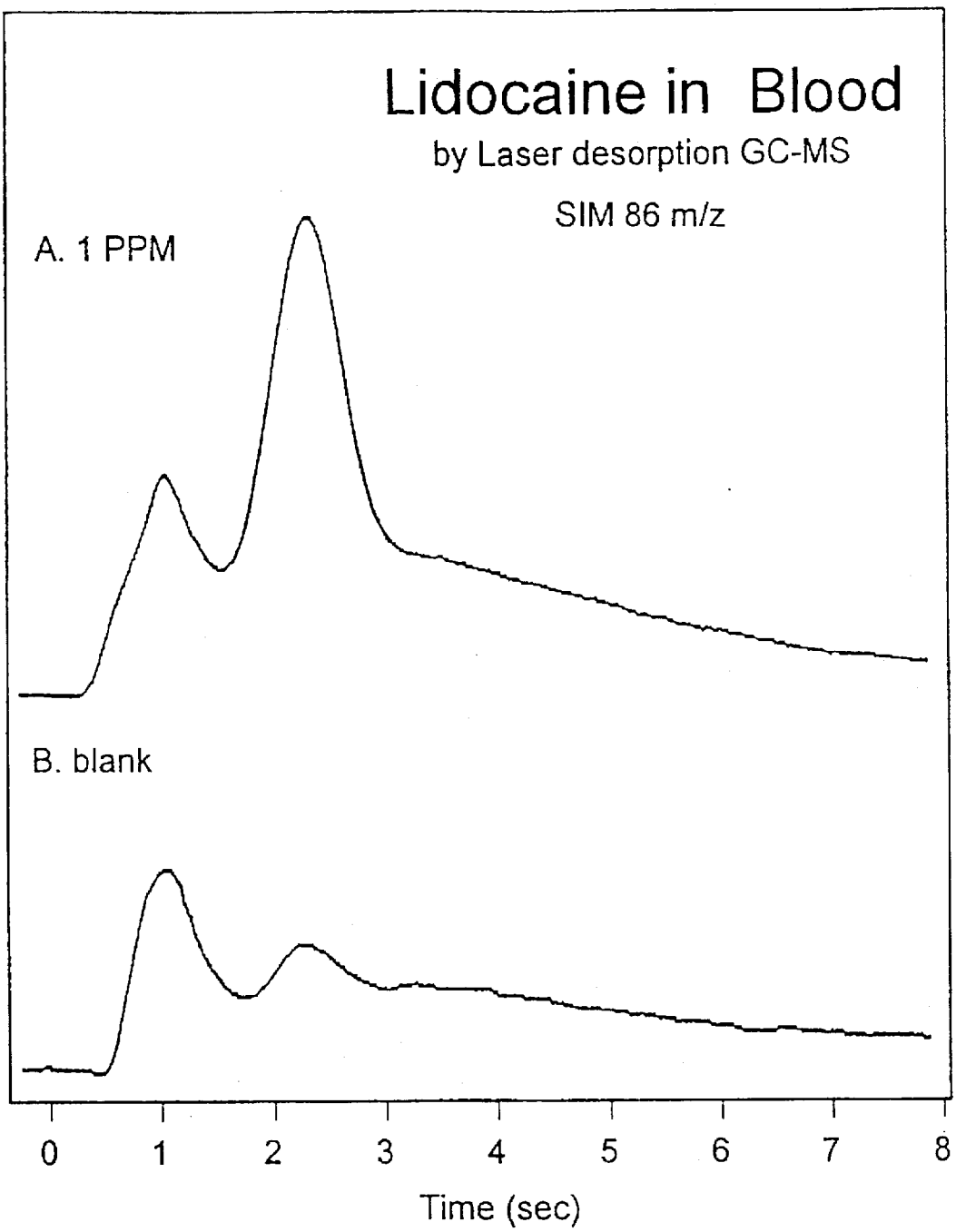

FIG. 6 illustrates the analysis of lidocaine drug spiked in mouse blood with the LD-GC-MS. A single ion monitoring trace at m/z 86 was used with a hyperthermal surface ionization ion source. In spite of the complexity of the blood matrix, the lidocaine peak is clearly observed and can be analyzed at 1 ppm level in blood in under 10 seconds, without sample preparation. A single drop of blood was used and each laser desorption injection evaporated an area of $10^{-4}$ $cm^2$ containing about 1 microgram of coagulated blood.

These applications uniquely demonstrate the effectiveness and analytical power according to the method of the present invention. Other examples of studied analysis include traces of lead as tetraethyllead from evaporated car gasoline, aldicarb and methylparathion pesticides from an orange leaf, caffeine drug from dry urine, cleaning process of a stainless steel surface from dioctylphthalate oil, plastic polymer composition, etc.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for sample introduction into a mass spectrometer for performing sample analysis, comprising:

desorbing a sample by means of a laser beam and forming gaseous sample compounds;

sweeping desorbed sample compounds with a carrier gas into a transfer line;

transferring the sample compounds in said transfer line into a supersonic nozzle;

expanding the sample compounds, mixed with said carrier gas, from the supersonic nozzle to form a supersonic free jet inside a vacuum chamber of a mass spectrometer, and ionizing and mass analyzing the sample compounds for the purpose of identification and/or quantification of said sample.

2. The method according to claim 1, wherein the supersonic free jet is further collimated to form a supersonic molecular beam.

3. The method according to claim 2, wherein the sample compounds are ionized in the supersonic molecular beam.

4. The method according to claim 1, wherein a portion of said transfer line is a column of a gas chromatograph utilized for the separation of said sample compounds in time.

5. The method according to claim 4, wherein said column of said gas chromatograph is a short column for fast GC-MS sample analysis.

6. The method according to claim 1, wherein said transfer line is heated.

7. The method according to claim 1, wherein said transfer line enables fast mass spectrometric sample analysis.

8. The method according to claim 1, wherein said sample analysis is performed in a MS—MS or $MS^n$ system.

9. The method according to claim 1, wherein said laser desorption is carried out in the open air at a pressure of about 1 atmosphere.

10. The method according to claim 1, wherein said laser desorption is carried out in a cell protected from ambient air by purging with the carrier gas.

11. The method according to claim 1, wherein said laser desorption is carried out at a controlled pressure upstream of the GC column.

12. The method according to claim 1, wherein said desorbing laser is a pulsed laser, transmitting pulsed beams.

13. The method according to claim 1, wherein said desorbing laser is a pulsed laser operating in a high frequency periodic fashion.

14. The method according to claim 1, wherein said laser light is absorbed by the sample, sample support or by an added reagent.

15. The method according to claim 1, wherein said laser desorption is performed by several laser pulses transmitted at a controlled repetition rate and total desorption time.

16. The method according to claim 1, wherein said laser desorption is optically aided by an inspection-microscope, for the visual identification of the analyzed area under the laser focused light.

17. The method according to claim 16, wherein the sample position relative to said laser beam is automatically controlled for the purpose of chemical mapping of a given sample surface.

18. The method according to claim 1, wherein the sample position relative to said laser beam is automatically controlled for the purpose of chemical mapping of a given sample surface.

19. The method according to claim 1, wherein said mass analysis is performed with a mass analyzer.

20. The method according to claim 1, wherein the ionizing of said sample compounds is achieved by electron induced ionization.

21. The method according to claim 1, wherein the ionizing of said sample compounds is achieved by hyperthermal surface ionization.

22. The method according to claim 1, wherein the ionizing of said sample compounds is achieved by laser induced ionization.

23. The method according to claim 1, wherein said laser desorption is achieved by means of sample vaporization.

24. The method according to claim 1, wherein said laser desorption is achieved by means of sample ablation.

25. The method according to claim 6, wherein said laser desorption is achieved by means of sample blasting into small dust particles which are further thermally vaporized inside the heated transfer line or GC.

26. An apparatus for sample introduction into a mass spectrometer for performing sample analysis, comprising:

a sample container arranged for positioning a sample to be analyzed therein for subsequent desorption by means of a laser beam directed thereon to form sample compounds;

means for introducing a carrier gas in said container for sweeping desorbed sample compounds into a transfer line being in fluid communication at one end thereof, with said container and leading to a supersonic nozzle at the other end thereof, to enable a supersonic free jet of said desorbed sample compounds to be expanded into a vacuum chamber of a mass spectrometer.

27. The apparatus according to claim 26, further comprising heating means at least partly surrounding a portion of said transfer line.

28. The apparatus according to claim 26, further comprising a gas chromatograph for time separation of the laser desorbed sample compounds located upstream of said supersonic nozzle.

29. The apparatus according to claim 26, further comprising a skimmer located downstream of said supersonic nozzle for skimming said free jet.

30. The apparatus according to claim 29, further comprising a differential pumping chamber through which said skimmed free jet is passed on its way into said vacuum chamber.

31. The apparatus according to claim 26, further comprising a microscope aimed for inspection of the sample in said container.

32. The apparatus according to claim 26, further comprising a dust and particle heated filter located along said transfer line.

33. The apparatus according to claim 26, further comprising means for introducing a make up gas flow into said transfer line upstream said supersonic nozzle.

* * * * *